US010147539B2

(12) United States Patent
Chastagnier et al.

(10) Patent No.: US 10,147,539 B2
(45) Date of Patent: Dec. 4, 2018

(54) MAGNETIC CORE OF ROTATING TRANSFORMER

(71) Applicant: SAFRAN ELECTRICAL & POWER, Blagnac (FR)

(72) Inventors: Jean-Michel Chastagnier, Briis Sous Forges (FR); Frederic Meer, Paris (FR)

(73) Assignee: Safran Electrical & Power, Blagnac (FR)

( * ) Notice: Subject to any disclaimer, the term of this patent is extended or adjusted under 35 U.S.C. 154(b) by 32 days.

(21) Appl. No.: 15/513,607

(22) PCT Filed: Sep. 24, 2015

(86) PCT No.: PCT/FR2015/052552
§ 371 (c)(1),
(2) Date: Mar. 23, 2017

(87) PCT Pub. No.: WO2016/046499
PCT Pub. Date: Mar. 31, 2016

(65) Prior Publication Data

US 2018/0233278 A1 Aug. 16, 2018

(30) Foreign Application Priority Data

Sep. 25, 2014 (FR) ..... 14 59081

(51) Int. Cl.
*H01F 21/06* (2006.01)
*H01F 21/04* (2006.01)
(Continued)

(52) U.S. Cl.
CPC ..... *H01F 38/18* (2013.01); *H01F 3/14* (2013.01); *H01F 27/245* (2013.01); *H01F 27/30* (2013.01); *H01F 27/32* (2013.01); *H01F 30/10* (2013.01)

(58) Field of Classification Search
USPC ..... 336/130
See application file for complete search history.

(56) References Cited

U.S. PATENT DOCUMENTS 5,347,256 A * 9/1994 Yumiki ..... G11B 5/53 336/120
5,786,650 A * 7/1998 Uchida ..... H02K 1/2773 310/156.55

(Continued)

FOREIGN PATENT DOCUMENTS

DE 10 2010 063 734 A1 6/2012
FR 1 306 964 A 10/1962
FR 96 427 E 6/1972

OTHER PUBLICATIONS

International Search Report dated Jan. 8, 2016 in PCT/FR2015/052552 filed Sep. 24, 2015.

*Primary Examiner* — Ronald Hinson
(74) *Attorney, Agent, or Firm* — Oblon, McClelland, Maier & Neustadt, L.L.P.

(57) ABSTRACT

A magnetic core for a rotary transformer, the core including bars arranged along a longitudinal axis of the core and at least two cheeks that are axially spaced apart from each other and that extend radially from the bars in order to cooperate with the bars to define at least one annular groove for receiving a toroidal coil, each cheek being made up of a packet of circular magnetic laminations that are arranged radially, and each bar being made up of a plurality of stacks of magnetic laminations, the stacks of laminations forming the bars being arranged axially and being assembled to the packets of circular laminations while being angularly spaced apart from one another around the longitudinal axis of the core.

9 Claims, 3 Drawing Sheets

(51) Int. Cl.

| | |
|---|---|
| ***H01F 38/18*** | (2006.01) |
| ***H01F 27/245*** | (2006.01) |
| ***H01F 30/10*** | (2006.01) |
| ***H01F 27/32*** | (2006.01) |
| ***H01F 3/14*** | (2006.01) |
| ***H01F 27/30*** | (2006.01) |

(56) References Cited

U.S. PATENT DOCUMENTS

| | | | | |
|---|---|---|---|---|
| 6,321,681 | B1 * | 11/2001 | Colpo | H01J 37/321 118/723 I |
| 2009/0295523 | A1 * | 12/2009 | Schwander | H01F 38/18 336/120 |
| 2013/0241367 | A1 * | 9/2013 | Taniguchi | H02K 11/0094 310/68 D |
| 2015/0145626 | A1 * | 5/2015 | Duval | H01F 30/12 336/10 |
| 2015/0206652 | A1 * | 7/2015 | Duval | H01F 30/14 336/5 |

* cited by examiner

MAGNETIC CORE OF ROTATING TRANSFORMER

BACKGROUND OF THE INVENTION

The present invention relates to the general field of axial type rotary transformers used for transferring electrical power by electromagnetic induction between two elements.

An axial type rotary transformer is typically made up of two elements of circular shape that are radially superposed, namely an inner core having one or more outer annular grooves receiving toroidal coils, and an outer core mounted coaxially around the inner core and having one or more inner annular grooves facing the outer grooves of the inner core and receiving toroidal coils. These two elements of circular shape are mounted coaxially so that one of the elements can rotate relative to the other about a common longitudinal axis.

Existing solutions for fabricating such an axial type rotary transformer consist in making the inner and outer cores from a sintered ferrite material or else, for transformers of small sizes, by machining high-resistivity cast iron. For the inner core, the toroidal coils can then be built up by winding them directly in its outer grooves. As for the outer core, the toroidal coils are usually received in the inner grooves by being deformed.

Nevertheless, such an architecture for a rotary transformer raises a certain number of problems. In particular, when the toroidal coils are of large section, it is not always possible to deform them to enable them to be received in the inner grooves of the outer core, which means that it then becomes necessary to build up the outer core around those coils. Furthermore, the materials used (sintered ferrite or cast iron) are fragile and cannot always withstand the severe vibratory environments to which they can possibly be subjected, particularly in the field of aviation.

OBJECT AND SUMMARY OF THE INVENTION

A main object of the present invention is to propose a magnetic core architecture for a rotary transformer that does not give rise to such drawbacks.

This object is achieved by means of a magnetic core for a rotary transformer, the core comprising bars arranged along a longitudinal axis of the core and at least two cheeks that are axially spaced apart from each other and that extend radially from the bars in order to cooperate with the bars to define at least one annular groove for receiving a toroidal coil, and wherein, in accordance with the invention, each cheek is made up of a packet of circular magnetic laminations that are arranged radially, and in that each bar is made up of a plurality of stacks of magnetic laminations, the stacks of laminations forming the bars being arranged axially and being assembled to the packets of circular laminations while being angularly spaced apart from one another around the longitudinal axis of the core.

The core of the invention is remarkable in that it comprises an arrangement of magnetic laminations for conveying the magnetic flux, firstly radially in the circular laminations forming the cheeks, and secondly axially in the laminations forming the bars. Such a structure thus makes it possible to facilitate assembling and industrializing an axial type rotary transformer, in particular by limiting both fabrication tooling and also re-working operations. In particular, with such a core, the toroidal coils may be made and insulated prior to constructing the core. Furthermore, the current losses are now minimized by the stacking and the insulation between the various laminations. Furthermore, it is possible to create particular points for passing connections to the coils of the transformer by making openings in the laminations.

In an advantageous provision, the circular laminations forming each cheek are segmented. Such segmentation of the circular laminations makes it possible to cancel the effects of a back electromotive force appearing in each circular lamination as a result of the magnetic field threading it. Specifically, sectorizing the circular laminations makes it possible to eliminate the induced circular currents that are due mainly to the alternating field lines threading the laminations.

Alternatively, still for countering the effects of a back electromotive force appearing in each circular lamination, each circular lamination forming a cheek includes radial notches forming internal baffles serving to lengthen the paths of the current loops.

In another advantageous provision, the circular laminations forming each cheek may present hollows. The presence of these hollows makes it possible to obtain a saving in weight, a reduction in leakage inductances, and to release passages for passing any connections.

The laminations of the stacks forming each bar may be stacked in radial directions. Alternatively, the laminations may be stacked in tangential directions.

The packets of circular laminations making up the cheeks may have axial notches in which the stacks of laminations forming the bars are assembled.

Under such circumstances, the core may advantageously further comprise spacers made of non-magnetic material arranged between the flanks of each stack of laminations forming the bars and the flanks of the notches in the packets of circular laminations. The presence of such spacers makes it possible to reduce the appearance of the currents in the cheeks by reducing the entry of magnetic flux in a direction normal to the plane of the laminations.

Furthermore, the core may advantageously further comprise insulating material arranged in bottoms of the notches in the packets of circular laminations. The presence of such insulating material makes it possible to avoid creating electrical contact between the circular lamination segments at the connections between the cheeks and the bars of the core.

The invention also provides a rotary transformer comprising an inner annular core and an outer annular core that are mounted coaxially around a common longitudinal axis so that one of the cores can rotate relative to the other about said longitudinal axis, at least one of the cores being a core as defined above.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF THE INVENTION

Figure 1:
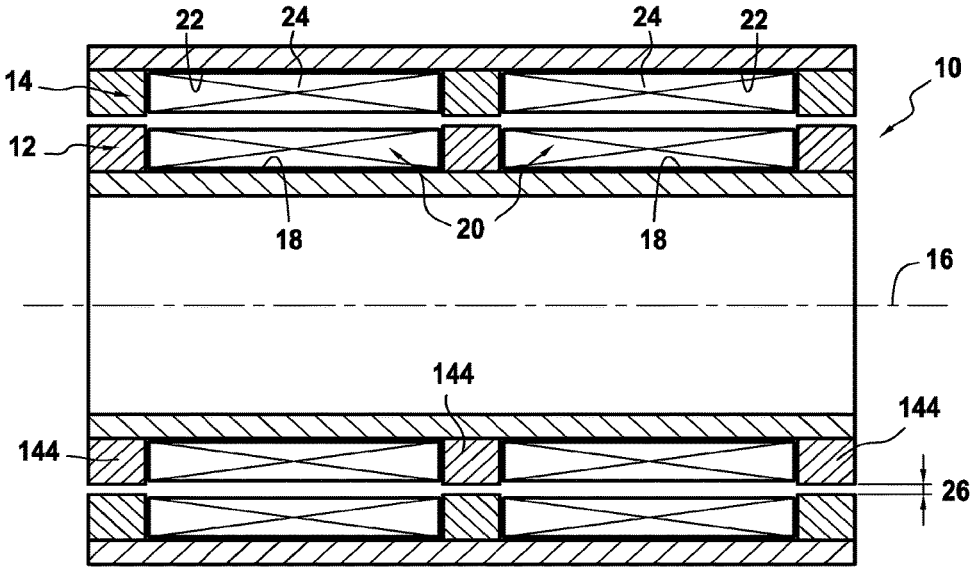
FIG. 1 is a diagrammatic view showing an example of an axial rotary transformer to which the invention applies.

The invention applies to any axial type rotary transformer (whether single phase or polyphase) used for transferring electrical power by electromagnetic induction between a stationary element and a rotary element, such as the three-phase rotary transformer 10 shown in FIG. 1.

In known manner, this rotary transformer 10 comprises an inner annular core 12 and an outer annular core 14 that are mounted coaxially around a common longitudinal axis 16 so that one of the cores can rotate relative to the other about said longitudinal axis 16.

The inner core 12 has two outer annular grooves 18 that receive toroidal coils 20, while the outer core 14 has two inner annular grooves 22 facing the outer groove 18 of the inner core and that likewise receive toroidal coils 24.

A radial airgap 26 is arranged between the inside diameter of the inner core 12 and the outside diameter of the outer core 14 so that it can rotate inside the inner core without making physical contact therewith.

Naturally, the invention applies likewise to single phase rotary transformers in which each core has only one groove and two cheeks for receiving a single toroidal coil. In the same manner, the invention applies to other rotary transformers that are polyphase, by varying the numbers of grooves and cheeks.

Figure 2:
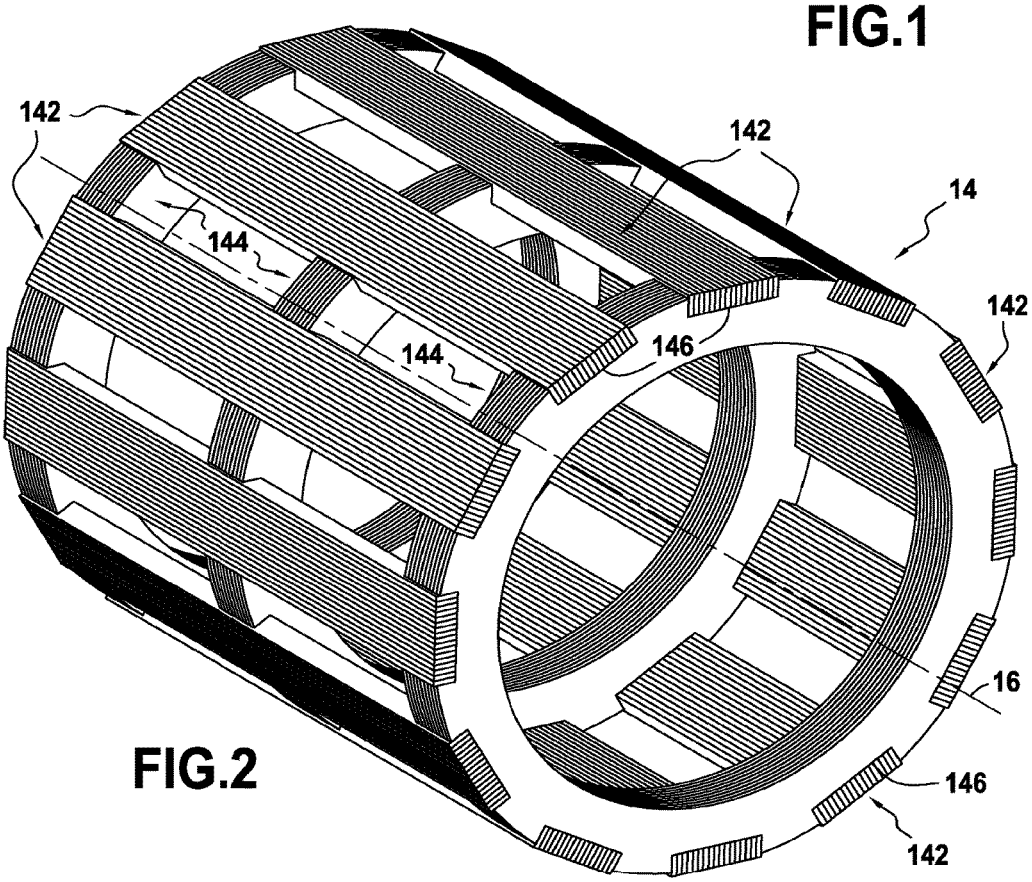
FIG. 2 is a perspective view of an outer core of a rotary transformer in an embodiment of the invention.
Figure 3:
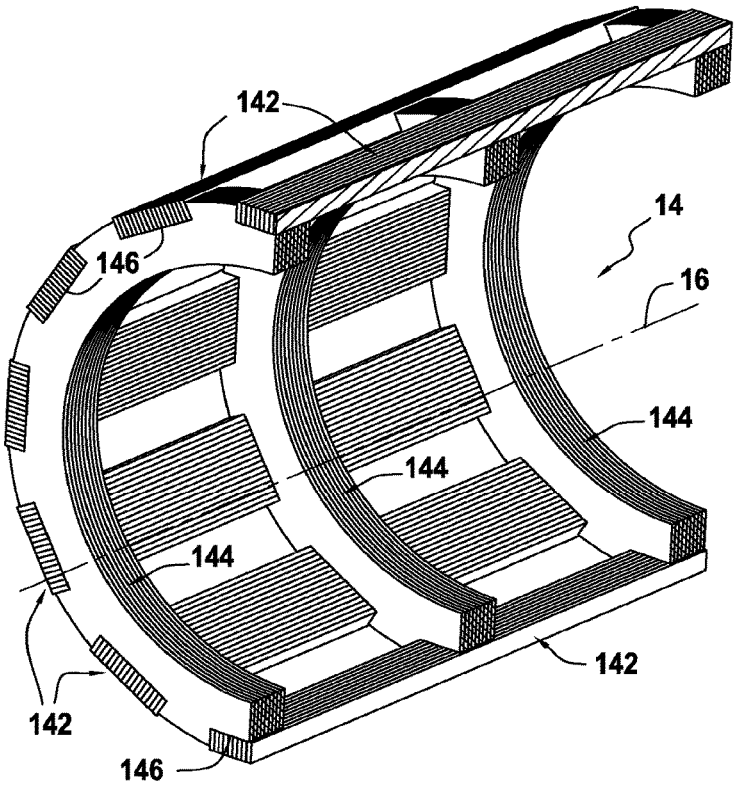
FIG. 3 is a longitudinal section view of the FIG. 2 core.

FIGS. 2 and 3 show an outer core 14 of such a rotary transformer in an embodiment of the invention. Naturally, the invention also applies to making the inner core.

According to the invention, the outer core 14 comprises bars 142 (also referred to as magnetic links, crowns, or yokes) that are arranged along the longitudinal axis 16 of the rotary transformer, each of these bars being made up of a plurality of stacks of magnetic laminations, e.g. of rectangular shape, which are arranged axially.

Thus, in the example of FIGS. 2 and 3, these stacks of laminations forming each of the bars are twelve in number, and they are regularly distributed around the longitudinal axis 16, with each of them being made up of seventeen rectangular laminations assembled together with interposed layers of insulation. Naturally, these numbers could be different, and likewise the shape of the laminations in the stacks need not necessarily be rectangular. In these stacks of rectangular laminations 142, the magnetic flux paths are axial.

Still in accordance with the invention, the outer core 14 likewise comprises three cheeks 144 (also referred to as circular cheeks or flanks) that are spaced apart axially from each other and that extend radially from the bars in order to co-operate therewith to define the two inner annular grooves 22 for receiving the toroidal coils 24, each cheek 144 being made up of a packet of magnetic laminations of circular shape that are arranged radially and assembled together with interposed layers of insulation.

In the example of FIGS. 2 and 3, each cheek 144 is thus constituted by a packet of ten circular magnetic laminations in which the magnetic flux paths are radial.

More precisely, each of the packets of circular laminations making up the cheeks 144 has axial notches 146 in which the stacks of laminations forming the bars 142 are assembled.

Furthermore, in the embodiment of FIGS. 2 and 3, the laminations of the stacks forming the bars 142 of the core are stacked in radial directions (i.e. these laminations are arranged in radial directions).

Figure 4:
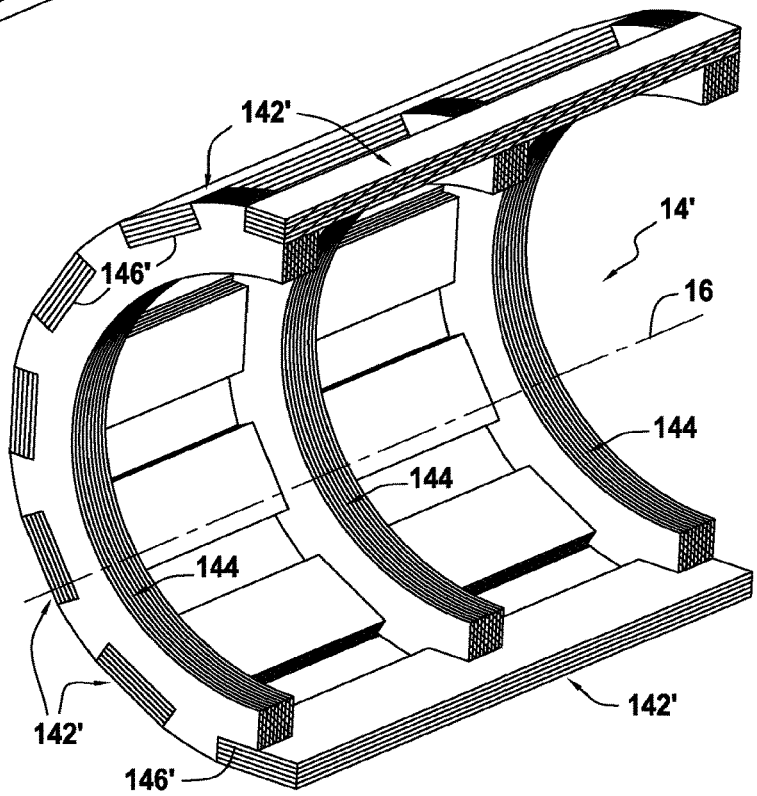
FIG. 4 is a perspective and longitudinal section view of an outer core of a rotary transformer in another embodiment of the invention.

FIG. 4 shows a variant embodiment of an outer core 14' in which the laminations of the stacks forming the bars 142' of the core have an orientation that is different, specifically they are stacked in tangential directions (i.e. these laminations are arranged in tangential directions).

In this example, each of the cheeks 144' likewise includes axial notches 146' in which the stacks of laminations forming the bars 142' are assembled, there being five of these laminations per stack, for example.

It should be observed that the laminations forming the bars and the circular laminations forming the cheeks of the core are typically magnetic laminations having non-oriented grains that are covered in a layer of insulation and pressed together to enable them to be assembled in the form of packets and of stacks.

With reference to FIGS. 5 to 8, there follows a description of various advantageous characteristics of the magnetic core of the invention.

In particular, each circular lamination of the packets of circular laminations forming the cheeks 144, 144' presents the drawback of being the seat of a back electromotive force due to the magnetic field threading it.

Figure 5:
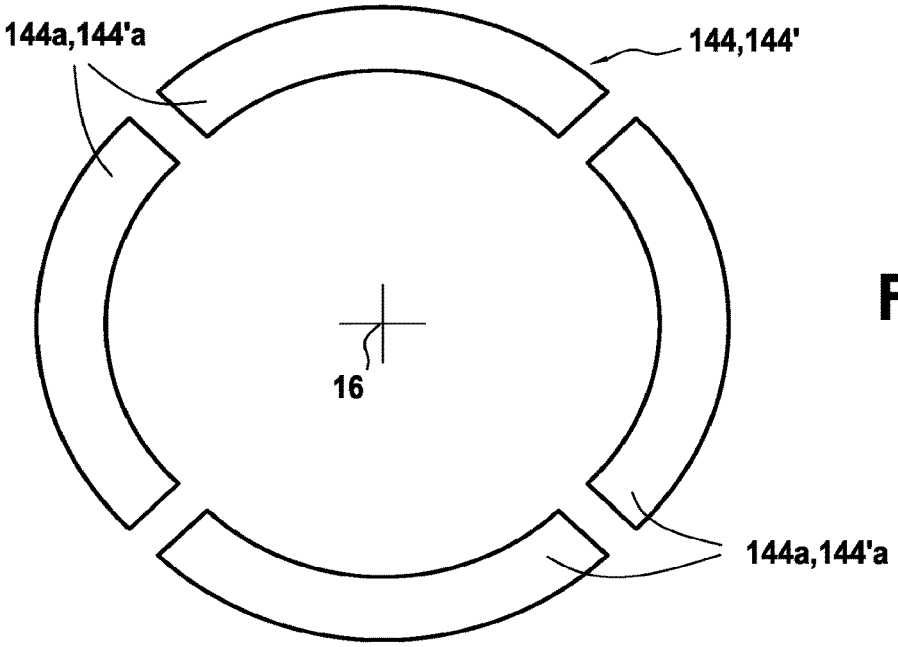
FIG. 5 shows the segmentation of an outer core cheek in accordance with an advantageous provision of the invention.

In order to cancel the induced circular current loops (current loops that are centered approximately on the longitudinal axis 16), it is possible, as shown in FIG. 5, to segment the circular laminations of the packets of circular laminations making up the cheeks 144, 144'. Thus, as shown in figures, each packet of circular laminations is segmented, e.g. into four segments 144*a*, 144'*a*, that are held together by means of adhesive or by mechanical retention using fastener elements such as screws, rivets, etc., these fastener elements having a system providing insulation relative to the laminations so as to avoid "re-looping" the induced circular currents. The number of segments may lie in the range two to thirty, approximately.

Segmenting the circular laminations in this way makes it possible to eliminate the induced circular current loops. All that remain are eddy currents, and they are greatly reduced by the small thickness of the laminations.

Figure 6:
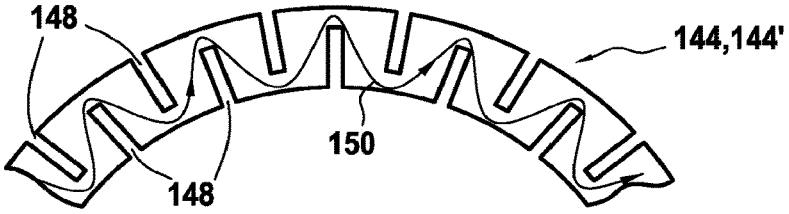
FIG. 6 shows how baffles are made in an outer core cheek in accordance with another advantageous provision of the invention.

Another solution for reducing the circular current loops induced in the circular laminations forming the cheeks of the magnetic core is shown in FIG. 6. It consists in creating baffles by making radial notches (or slots) 148 in the circular laminations. As shown in FIG. 6, the path followed by the current loops (represented diagrammatically by the line 150) is thereby lengthened.

Still another solution (not shown in the figures) for reducing the circular current loops induced in the circular laminations is to wind the circular laminations spirally so as to avoid creating rings.

Furthermore, in order to reduce the appearance of eddy currents in the circular laminations forming the cheeks 144, 144', it is preferable to reduce as much as possible the entry of the magnetic induction vector in a direction normal to the plane of the magnetic laminations.

Figure 7:
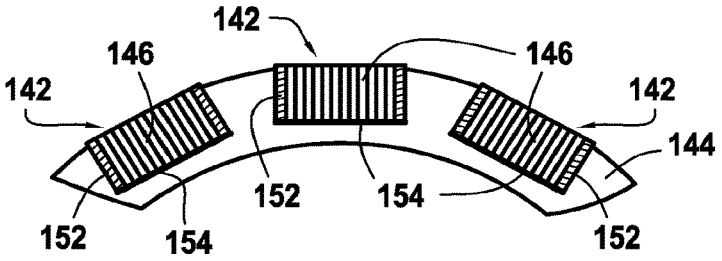
FIG. 7 shows the presence of non-magnetic spacers and of insulating material between the cheeks and the bars of an outer core in accordance with yet other advantageous provisions of the invention.

For this purpose, as shown in FIG. 7, provision is advantageously made to arrange spacers 152 of non-magnetic material between the flanks of each stack of laminations forming the bars and the flanks of the notches 146 in the packets of circular laminations 144 in which the laminations forming the bars are assembled. Typically, the spacers 152 may be made of a polymer matrix composite material or a non-ferromagnetic metal material (e.g. of aluminum alloy).

Alternatively, provision could be made to leave an empty space between the flanks of the stacks of laminations forming the bars and the flanks of the notches in the packets of circular laminations, which empty space may be filled in with resin.

Furthermore, when the circular laminations of the packets of circular laminations forming the cheeks 144, 144' of the magnetic core are segmented (as shown in FIG. 5), there is a risk that the direct contact between the stacks of laminations forming the bars and the cheeks gives rise to electrical contact between the various segments of the circular laminations, thereby cancelling the effect of the segmentation.

In order to avoid such a phenomenon, provision is advantageously made to arrange an insulating material 154 in the bottoms of the notches 146 in the packets of circular laminations 144 (FIG. 7). For example, this insulating material 154 may be in the form of a sheet of very small thickness (typically of the order of a few hundredths of a millimeter) made of fiberglass or of a polymer film of polyimide type or of polyether ether ketone (PEEK) type.

Alternatively, the insulating material may be a varnish or a suitable adhesive, or it may be made by creating a nonconductive gap by placing abutments that prevent direct contact between the stacks of laminations forming the bars and the cheeks.

Figure 8:
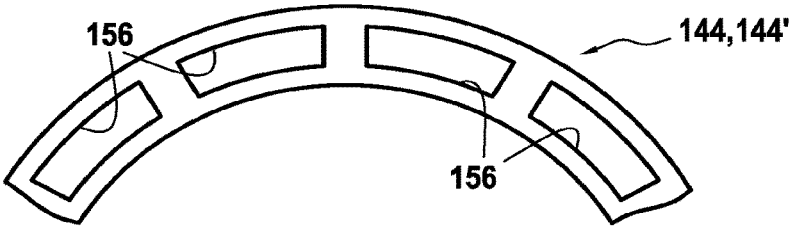
FIG. 8 shows how recesses are made in an outer core cheek in accordance with yet another advantageous provision of the invention.

In yet another advantageous provision of the invention, as shown in FIG. 8, the circular laminations forming each cheek 144, 144' of the core present internal hollows 156.

Such hollows 156 serve to obtain a saving in weight, and a reduction in leakage inductances, and they also release a passage for possible electrical connections.

The invention claimed is:

1. A magnetic core for a rotary transformer, the core comprising bars arranged along a longitudinal axis of the core and at least two cheeks that are axially spaced apart from each other and that extend radially from the bars in order to cooperate with the bars to define at least one annular groove for receiving a toroidal coil, each cheek being made up of a packet of circular magnetic laminations that are arranged radially, each bar being made up of a plurality of stacks of magnetic laminations, the stacks of laminations forming the bars being arranged axially and being assembled to the packets of circular laminations while being angularly spaced apart from one another around the longitudinal axis of the core, wherein each circular lamination forming a cheek includes radial notches forming internal baffles serving to lengthen the paths of current loops.

2. The core according to claim 1, wherein the circular laminations forming each cheek are segmented.

3. The core according to claim 1, wherein the circular laminations forming each cheek present hollows.

4. The core according to claim 1, wherein the laminations of the stacks forming each bar are stacked in radial directions.

5. The core according to claim 1, wherein the laminations of the stacks forming each bar are stacked in tangential directions.

6. A rotary transformer comprising an inner annular core and an outer annular core that are mounted coaxially around a common longitudinal axis so that one of the cores can rotate relative to the other about said longitudinal axis, wherein at least one of the cores is a core according to claim 1.

7. The core according to claim 1, wherein the packets of circular laminations making up the cheeks have axial notches in which the stacks of laminations forming the bars are assembled.

8. The core according to claim 7, further comprising spacers made of non-magnetic material arranged between the flanks of each stack of laminations forming the bars and the flanks of the notches in the packets of circular laminations.

9. The core according to claim 7, further comprising insulating material arranged in bottoms of the notches in the packets of circular laminations.

* * * * *